United States Patent [19]

Coleman et al.

[11] Patent Number: 4,574,863

[45] Date of Patent: Mar. 11, 1986

[54] AISLE CLOSER APPARATUS

[75] Inventors: Larry Coleman, Wayne; Fred Van Duyne, Ringwood, both of N.J.

[73] Assignee: Melrose Displays, Inc., Passaic, N.J.

[21] Appl. No.: 524,980

[22] Filed: Aug. 22, 1983

[51] Int. Cl.[4] ..... A47F 10/00

[52] U.S. Cl. ..... 160/216; 52/33

[58] Field of Search ..... 160/127-130, 160/216, 87, 89, 97, 197, 202, 225, 206; 52/33; 186/59, 60; 49/49

[56] References Cited

U.S. PATENT DOCUMENTS

| | | | |
|---|---|---|---|
| 950,788 | 3/1910 | Williams | 160/97 |
| 1,060,132 | 4/1913 | Schaefer | 160/206 |
| 1,196,443 | 8/1916 | Ellis | 160/225 |
| 1,245,237 | 11/1917 | Johnston | 160/89 |
| 1,273,838 | 7/1918 | Fairhurst | 160/37 |
| 1,494,390 | 5/1924 | Stevenson | 52/33 |
| 2,907,616 | 10/1959 | Sullivan | 108/66 |
| 3,182,357 | 5/1965 | Tuttle | 52/33 |
| 3,216,482 | 11/1965 | Lindholm | 160/216 |
| 4,495,978 | 1/1985 | Carroll | 160/117 R |

*Primary Examiner*—Ramon S. Britts
*Assistant Examiner*—Cherney S. Lieberman
*Attorney, Agent, or Firm*—Lackenbach Siegel Marzullo Presta & Aronson

[57] ABSTRACT

The present invention relates to an apparatus for closing or opening an aisle in a supermarket or similar store. The apparatus includes a support member having a vertical surface having upper and lower U-channels adapted to slidingly receive a first panel. A second panel is hinged to the first panel by a biased hinge. A bar member having a finger is attached to the upper channel and is adapted to fit into or be raised from a position where the finger inhibits sliding movement of a first panel which is adapted to be slid between unextended and extended positions, with the second panel capable of rotation between folded and unfolded positions in which the biased hinge releasably holds the second panel in said positions.

11 Claims, 12 Drawing Figures

AISLE CLOSER APPARATUS

BACKGROUND OF THE INVENTION

This invention relates generally to an aisle closer apparatus and in particular to an aisle closer apparatus for use in supermarket checkout aisles.

The cash registers assigned to grocery checkout aisles in supermarkets having more than one checkout aisle are constantly being put into service as the customer demand increases or taken out of service as customer demand recedes. Simple and easy-to-operate aisle closing means are advantageous to indicate when a register is closed. Often a supermarket uses a small sign on the checkout counter that a customer does not see, especially when a checkout clerk is standing at a register processing receipts. The time of the customer is wasted in waiting at a closed register and the attention of the clerk is diverted from the work to inform customers that the register is closed.

SUMMARY OF THE INVENTION

Accordingly, it is an object of the present invention to provide an aisle closer that is simple to operate; and that is positioned proximate to a customer checkout aisle.

It is another object of the present invention to provide an aisle closer that can be affixed to a display rack that is positioned on one side of the aisle.

It is another object of the present invention to provide an aisle closer that can be positioned to completely close an aisle.

It is a further object of this invention to provide an aisle closer that includes a support surface affixed to a display rack with a first panel slidingly mounted to the support surface and a second panel hingedly mounted to the first panel so that the apparatus can be opened and closed by sliding the first panel and rotating the second panel.

It is a further object of this invention to provide an aisle closer that hingedly mounts a second panel to a first sliding panel by way of a hinge that is capable of rotatably moving the second panel and the first panel between a folded position and an unfolded position and capable of locking the first and second panels in folded and unfolded positions.

It is a further object of the present invention to provide an aisle closer capable of being releasably inhibited in both an open and a closed position.

Accordingly, in order to achieve the above objects, as well as others which will become apparent hereafter, an aisle closer is provided that includes a support means and first and second vertical panels, the first panel being positioned between the support means and the second panel. The first panel is preferably affixed on one side to a display rack next to an aisle next to a supermarket cash register. Upper and lower U-channels are connected to the upper and lower portions respectively of the vertical wall of the support member. The first panel is slidably mounted in the U-channels, the upper U-channel being downward facing and the lower U-channel being upward facing. The first panel is movable in the upper and lower U-channels between an unextended position and an extended position, wherein in the unextended position the first side of the first panel is facing and proximate to the support means and the end portions of the support means and the first panel are in substantial alignment, and wherein in the extended position the end of the first panel is distantly positioned beyond the end of the support means.

The support means includes a display rack or similar standing unit next to the aisle being closed. The standing unit includes a vertical surface transverse to the aisle being closed and a vertical side edge adjoining the aisle. A separate support member having opposed vertical sides may be affixed to the surface of the standing unit by way of one of the vertical sides, and the U-channels may be affixed to the other of the vertical sides of the support member.

A hinge is connected to the end portion of the first panel and to an end portion of the second panel. The hinge is capable of allowing rotatable movement of the second panel relative to the first panel between a folded position and an unfolded position. The hinge is further capable of holding the first and second panels in the folded an unfolded positions. In the folded position, the first and second panels are approximately parallel and the second side of the first panel is facing and proximate to the second panel and the end portions of the first and second panels are in substantial alignment; and in the unfolded position the second panel is positioned lengthwise in planar relationship to the first panel with the end portions of the first and second panels being in adjacent relationship. The apparatus is movable between an open position and a closed position, wherein in the open position the support means and the first panel are in the unextended position and the first and second panels are in the folded position; and wherein in the closed position the support means and the first panel are in the extended position and the first and second panels are in the folded position.

The hinge described above is a spring biased hinge described in U.S. Pat. No. 2,907,616.

The support means and the first panel are inhibited from moving from the described unextended and extended positions by a finger extending from the upper U-channel through a recess in the top of the U-channel in removable frictional relationship in a space between the support and the first panel, specifically between the inner wall of the upper U-channel and the first panel.

The present invention will be better understood and the objects and important features, other than those specifically enumerated above, will become apparent when consideration is given to the following details and description, which, when taken in conjunction with the annexed drawings, describes, discloses, illustrates, and shows a preferred embodiment or modification of the present invention and what is presently considered and believed to be the best mode of practice of the principles thereof. Other embodiments or modifications may be suggested to those having the benefit of the teachings herein and such other embodiments or modifications are intended to be reserved especially as they fall within the scope and spirit of the subjoined claims.

DESCRIPTION OF THE PREFERRED EMBODIMENTS

Figure 1:
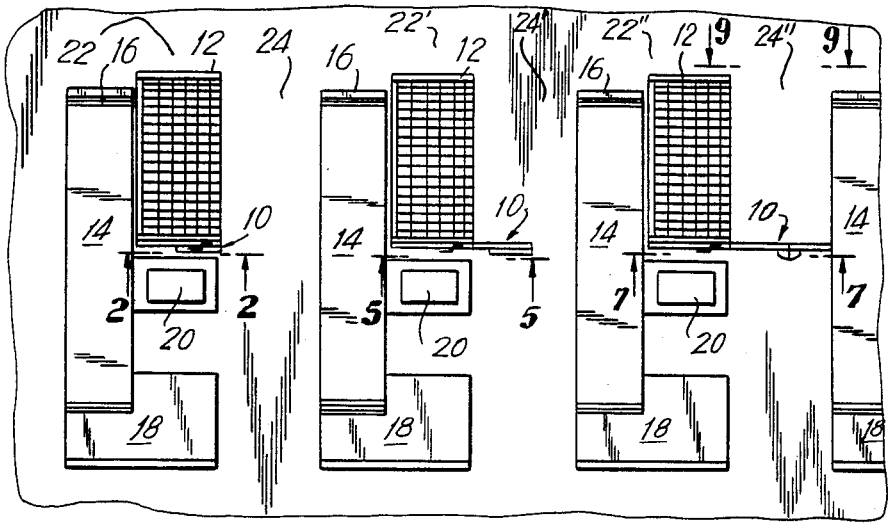
FIG. 1 is a plan view showing the present invention in open, partially closed, and closed positions in an environment having multiple checkout aisles.

Reference is now made in detail specifically in the drawings, in which identical or similar parts are designated by the same reference numerals throughout.

FIG. 1 illustrates a partial floor plan of a supermarket environment showing an aisle closer apparatus 10 positioned adjoining each of three display racks 12. Each display rack 12 adjoins a checkout loading platform 14. Display rack 12 is positioned at the loading end portion 16 of platform 14 and a bagging platform 18 is positioned at the end of platform 14 opposite loading end portion 16. A cash register 20 is positioned adjoining loading platform 14 between loading end portion 16 and bagging platform 18. Display rack 18 adjoins both loading end portion 16 and cash register 20, which in turn is spaced from bagging platform 18 to allow room for a checkout clerk. Each display rack 12, checkout platform 14, bagging platform 18, and cash register 20 comprise a checkout unit shown as checkout units 22, 22′ and 22″, each of which are spaced from one another to form aisles 24, 24′ and 24″ in which a customer stands while his or her goods are being totalled in register 20. The customers enter aisles 24, 24′ and 24″ at loading end portion 16 of platform 14 and leave at bagging platform 18. Note that the aisle closer which is behind each cash register 20 when used closes the next aisle over from the checkout unit.

FIG. 1 illustrates three adjacent checkout aisles 24, 24′, and 24″. Each unit 22, 22′ and 22″ is provided with aisle closer units 10 shown. First, in an open position is unit 22 in relation to aisle 24; second, in a partially open, that is, a partially closed position, is unit 22′ in relation to aisle 24′; and, third, in a fully closed position associated with unit 22″ across aisle 24″ is unit 22″.

Figure 2:
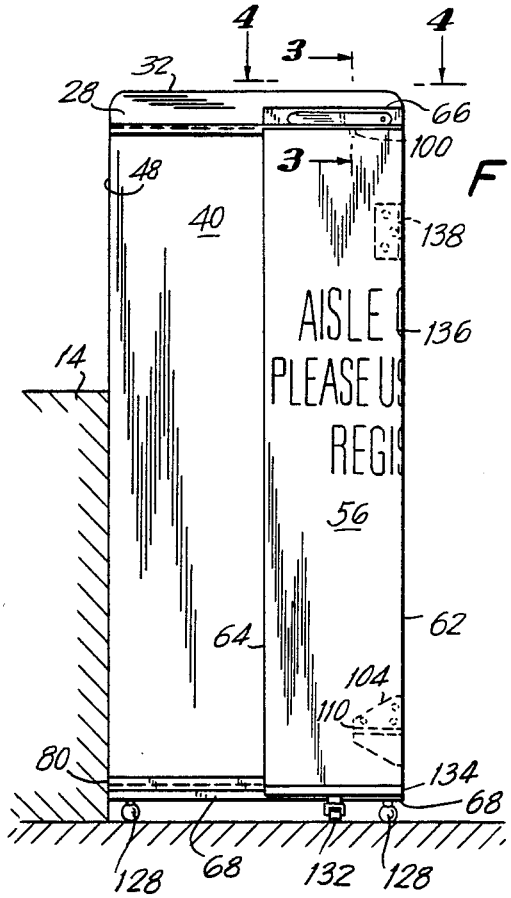
FIG. 2 is a view taken through line 2—2 of FIG. 1.
Figure 5:
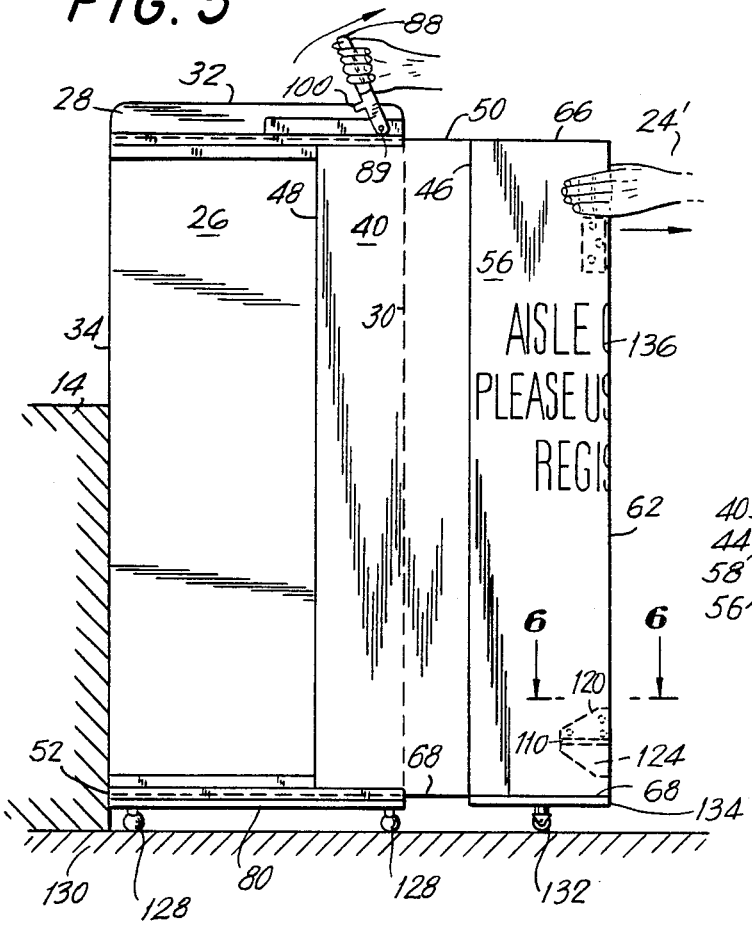
FIG. 5 is a view taken through line 5—5 of FIG. 1.
Figure 9:
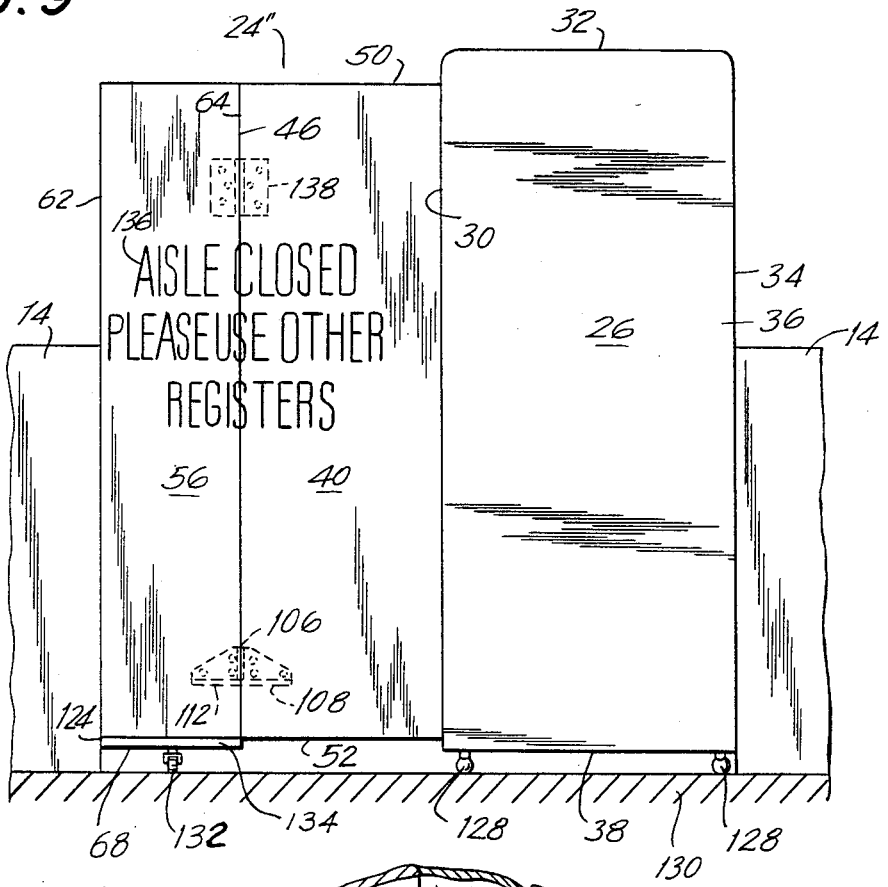
FIG. 9 is a view taken through line 9—9 of FIG. 1.

Discussion of aisle closer 10 will proceed in accordance with the open, partially closed, and closed positions, noted above, and specifically as shown in FIGS. 2, 5, and 7, respectively. FIG. 9 also shows aisle closer 10 in a closed position, but from an opposite side from FIG. 7 and as seen by a customer.

FIGS. 2, 5, 7 and 9 are being referred to when basic structure of apparatus 10 is being described.

Figure 3:
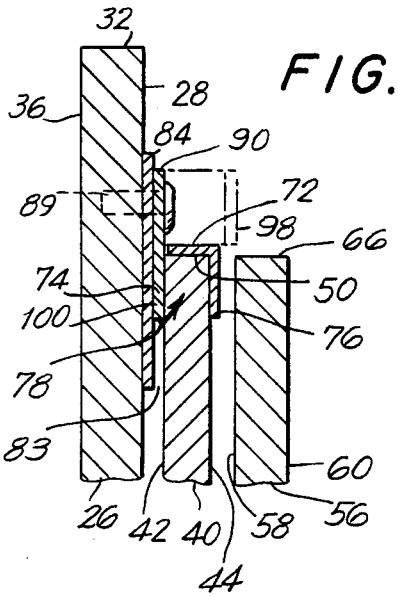
FIG. 3 is a view taken through line 3—3 of FIG. 2.

Aisle closer 10 includes a support member 26, shown in the figure as a flat panel, that is integral with display rack 12. Support member 26 in most cases will be already mounted on display rack 12, but support member 26 can be affixed in a known manner to display rack 12. Support member 26, as is aisle closer 10 in general, is positioned between cash register 20 and an end of display rack 12 with which side support member 26 is integral. Support member 26 is substantially transverse to aisles 24, 24′ and 24″. Support member 26 includes a substantially vertical, flat surface 28 and a substantially vertical inner side edge 30 that is located at the side of each aisle 24, 24′ and 24″ and that intersects surface 28. In addition, support member 26 includes a substantially horizontal top edge 32 that intersects surface 28 and side edge 30. Opposing side edge 30 is a substantially vertical outer side edge 34 that intersects surface 28 and top edge 32. FIG. 3 illustrates a substantially flat, vertical wall 36 opposing surface 28 and intersecting side edges 30 and 34 and top edge 32. Vertical rear wall 36 is affixed to one end of display rack 12 as described above. As best seen in FIG. 9, support member 26 includes a substantially horizontal bottom edge 38 that intersects surface 28 and side edges 30 and 34.

Figure 4:
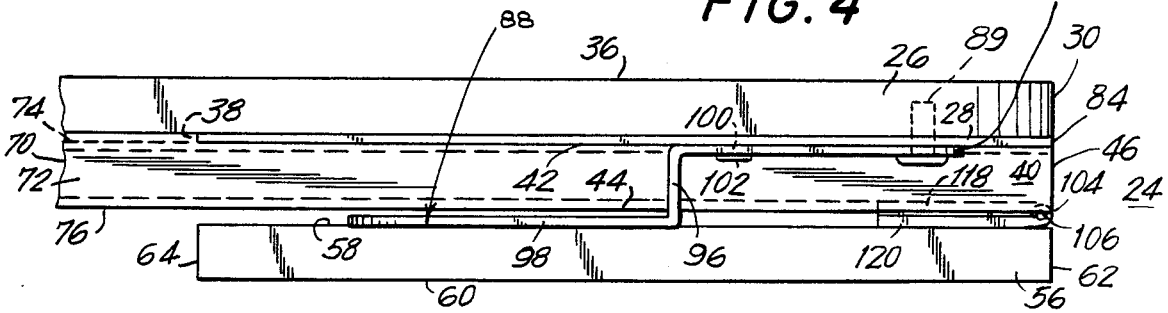
FIG. 4 is a view taken through line 4—4 of FIG. 2.

A middle, or first panel 40 having opposed first and second substantially vertical, flat side surfaces, or walls, 42 and 44, and substantially vertical opposed inner and outer side edges 46 and 48, respectively, intersecting first and second side walls 42 and 44 is positioned laterally proximate to support member 26 and more particularly positioned so that first and second walls 42 and 44 are substantially parallel to surface 28, with first wall 42 proximate to and facing surface 28 in the closed position of aisle closer 10. First panel 40 also includes opposed, substantially horizontal, upper and lower edges 50 and 52, respectively, that intersect first and second walls 42 and 44 and side edges 46 and 48. As best seen in FIG. 4, inner edge 46 is substantially aligned with side edge 30 of support member 26 when aisle closer 10 is in the closed position shown in FIGS. 2, 3 and 4 and in aisle 24 of FIG. 1. Side edge 48 of first panel 40 is substantially aligned with side edge 34 of support member 26 as is lower edge 52 with bottom edge 38.

An outer or second panel 56 having opposed inner and outer substantially vertical, flat side surfaces, or walls, 58 and 60, and substantially vertical opposed inner and outer side edges 62 and 64, respectively, intersecting inner and outer side walls 58 and 60 is positioned laterally proximate to second panel 56 and, more particularly, positioned so that inner and outer walls 58 and 60 are substantially parallel to second side wall 44 of first panel 40, with inner wall 58 proximate to and facing second side wall 44 in the closed position of aisle closer 10. Second panel 56 also includes opposed, substantially horizontal, upper and lower edges 66 and 68 respectively that intersect inner and outer walls 58 and 60 and side edges 62 and 64. As best seen in FIG. 4, inner edge 62 is substantially aligned with side edge 46 of first panel 40 when aisle closer 10 is in the closed position shown in FIGS. 2, 3, 4 and in aisle 24 of FIG. 1. Outer side edge 34 of support member 26 and outer side edge 48 of first panel 40 are preferably in substantial alignment. Outer side edge 48, of course, can be vertically spaced from outer side edge 34 within the spirit of the invention.

An upper channel member 70 is affixed to the upper portion of surface 28 of support member 26 between side edge 30 and side edge 34. Upper channel member 70 includes a substantially horizontal channel top wall 72 and substantially vertical first and second side walls 74 and 76, respectively, secured to channel top wall 72, channel top wall 72 and channel first and second side walls forming an elongated downward facing upper slot 78. A substantially horizontal lower channel member 80 matingly opposed to upper channel member 70 is affixed to the lower portion of surface 28 of support member 26 between side edge 30 and side edge 34. Lower channel member 80 is affixed to surface 28 at bottom edge 38, while upper channel member 70 is preferably spaced below top edge 32. Lower channel member 80 forms an elongated upward facing lower slot 82 that mates with upper slot 78 so that upper and lower slots 78 and 82 are adapted to slidably receive upper edge 50 and lower edge 52 of first panel 40, respectively. First side wall 42 is spaced from channel first side wall so as to form a vertical space, or gap 83. Upper channel member 70 includes a connecting plate member 84 secured to first side wall 74 and to surface 28 of support member 26 via a pair of mounting screw holes 86 (shown in FIG. 11). Connecting plate member 84 preferably extends from side edge 30 of support member 26 to end of upper channel member 70 spaced away from side edge 30.

As best seen in either FIG. 3 or 4, substantially horizontal bar member 88 includes an elongated bar portion 90 that is positioned directly over elongated gap 83. Bar portion 90 has a connecting end 92 to rotatably connect to connected plate member 84 via pin 89 from side edge 30 of support member 26 and an opposed end 94 distal from side edge 30. Bar member 88 also includes a cross-bar 96 connected at one end to opposed end 94; bar member 88 extends transversely over upper channel member 70. Bar member 88 also includes an elongated handle portion 98 that is connected to the opposite end of cross-bar 96; handle portion 98 extends lateral to bar portion 90 and away from side edges 30. A finger member 100 extends substantially perpendicularly from the underside of bar portion 90. Top wall 72 of upper channel member 70 forms a recess 102 that opens into gap 83 and is adapted to receive finger member 100. Bar member 88 is rotatable about connecting end 92 between an inhibiting position and a free position. In the inhibiting position finger member 100 is positioned through recess 102 into gap 83 in frictional relationship with plate member 84 and with first side wall 42 of first panel 40; and in the free position finger member 100 is spaced away from gap 83, recess 102, and top wall 72 of upper channel member 70.

Figure 6:
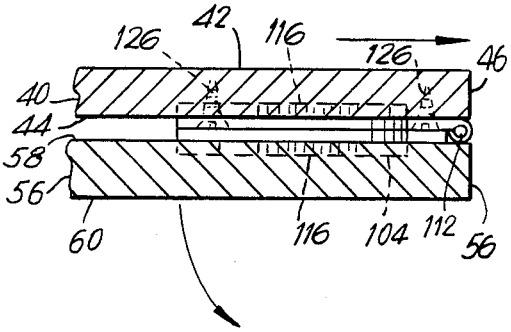
FIG. 6 is a view taken through line 6—6 of FIG. 5.
Figure 7:
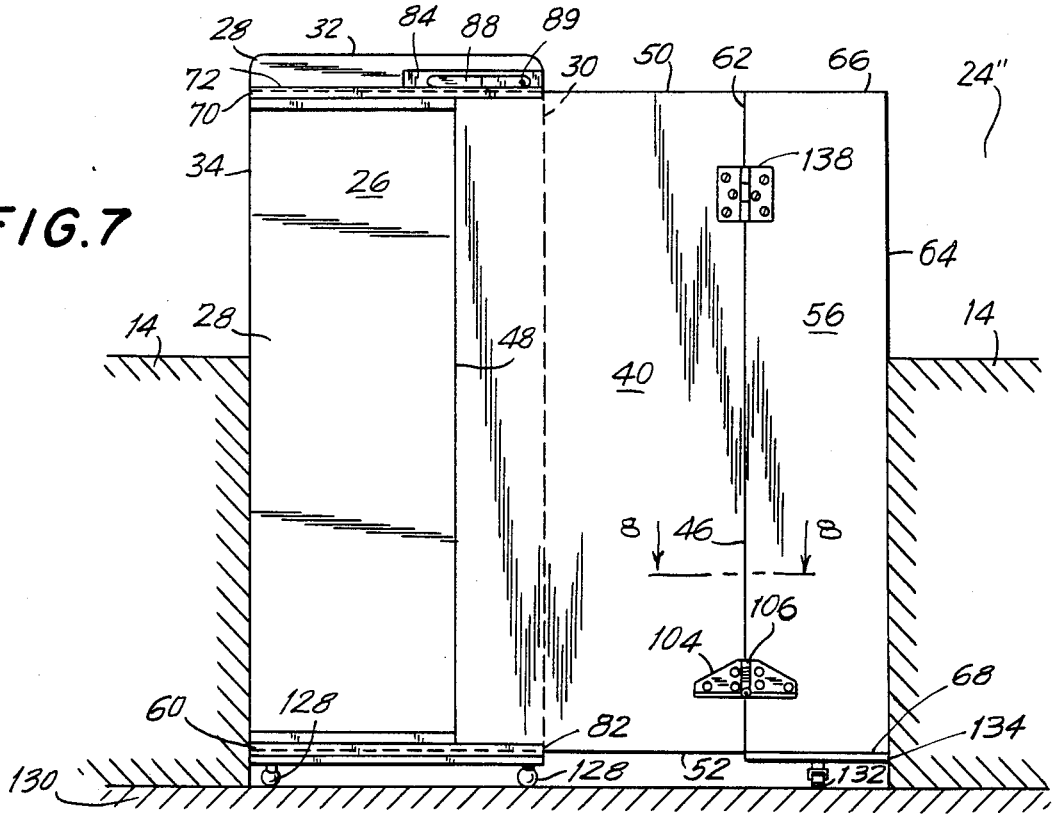
FIG. 7 is a view taken through line 7—7 of FIG. 1.
Figure 8:
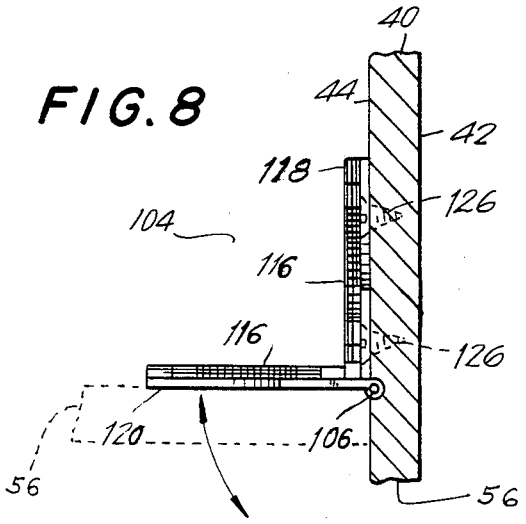
FIG. 8 is a view taken through line 8—8 of FIG. 7.
Figure 10:
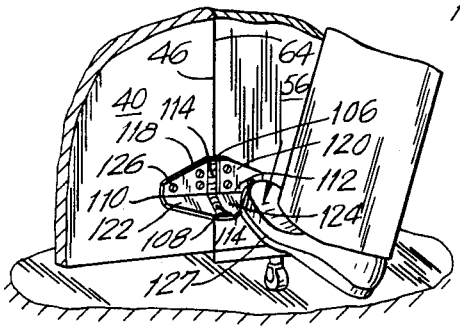
FIG. 10 is a perspective view of the hinge member of the present invention.

As seen in FIGS. 4, 6, 7, 8 and 10, a hinge 104 is connected to second side wall 44 at inner side edge 46 of first panel 40 and to inner side wall 58 at inner side edge 62 of second panel 56 in a manner to be explained. Hinge 104 is the device described in U.S. Pat. No. 2,907,616 as discussed previously. Hinge 104 includes a pair of vertical joints 106 and 108 and a pair of horizontal joints 110 and 112. Each of the vertical joints 106 and 108 is provided with a pair of torsion springs 114; and each of the horizontal joints 110 and 112 is provided with a pair of torsion springs 116 (shown in FIG. 8). Hinge 104 includes a pair of upper plates 118 and 120 and a pair of lower plates 122 and 124, with upper plates 118 being secured to wall 44 of first panel 40 and upper plates 120 being secured to inner side wall 58 of second panel 56 by screws 126. Hinge 104 allows rotational movement of second panel 56 relative to first panel 40 between a folded position as shown in FIGS. 4 and 6, wherein second side wall 44 of first panel 40 and inner side wall 58 of second panel 56 are substantially parallel and facing one another in spaced proximity, and an unfolded position as shown in FIGS. 7 and 10, wherein inner and outer side walls 58 and 60 of second panel 56 are positioned lengthwise in planar relationship with second and first side walls 44 and 42, respectively, of first panel 40. FIG. 8 shows hinge 104 with panels 40 and 56 being rotated in midway position between the folded (shown in phantom) and unfolded positions. In the folded position, upper plate 118 and lower plate 122 are in planar relationship as are upper plate 120 and lower plate 124. Hinge 104 is releasably held in the folded position by the vertical torsion springs 114.

In the unfolded position, lower plates 112 and 125 are positioned at substantially right angles to upper plates 118 and 120. Hinge 104 is releasably held in the unfolded position by the horizontal torsion springs 116. When hinge 104 is moved from the folded to the unfolded position, horizontal torsion springs 116 are released to bias lower plates 122 and 124 into the unfolded position to right angles with upper plates 118 and 120. And, in the movement from the unfolded to the folded position, a user, as shown in FIG. 10, preferably uses a foot 127 to pressure lower plates 122 and 124 to release to a planar relationship with upper plates 118 and 120, at which position horizontal torsion springs 116 bias hinge 104 to the folded position. For this reason, it is preferred that hinge 104 be positioned at the bottom portions of first and second panels 40 and 56. It is particularly noted that in the folded position vertical torsion springs 114 bias hinge 104 to remain in the folded position and that in the unfolded position horizontal torsion springs 116 bias hinge 104 to remain in the unfolded position, both positions being releasable when a user pressures hinge 104 against the bias.

Aisle closer 10 as a system is movable between an open position and a closed position, wherein in the open position first panel 40 is in the unextended position and first and second panels 40 and 56 are in the folded position, and in the closed position first panel 40 is in the extended position relative to support member 26 and first and second panels 40 and 56 are in the unfolded position.

Support member 26 is preferably supported by a pair of spaced foot members 128 that are secured to the underside of lower channel member 80 and rest upon a floor 130. Second panel 56 is preferably supported by a vertically adjustable mobile wheel 132 connected to the underside of a horizontal support channel 134 secured to lower edge 68 so as to compensate for any uneven flowing.

As shown in FIG. 1, aisle closer 10 is in the closed position leaving aisle 24 of checkout unit 22 open. In a partially open position shown in aisle 24' at checkout unit 22', aisle closer 10 is partially extended across aisle 24'. Aisle closer 10 is shown in a closed position across aisle 24'' at checkout unit 22''.

Figure 11:
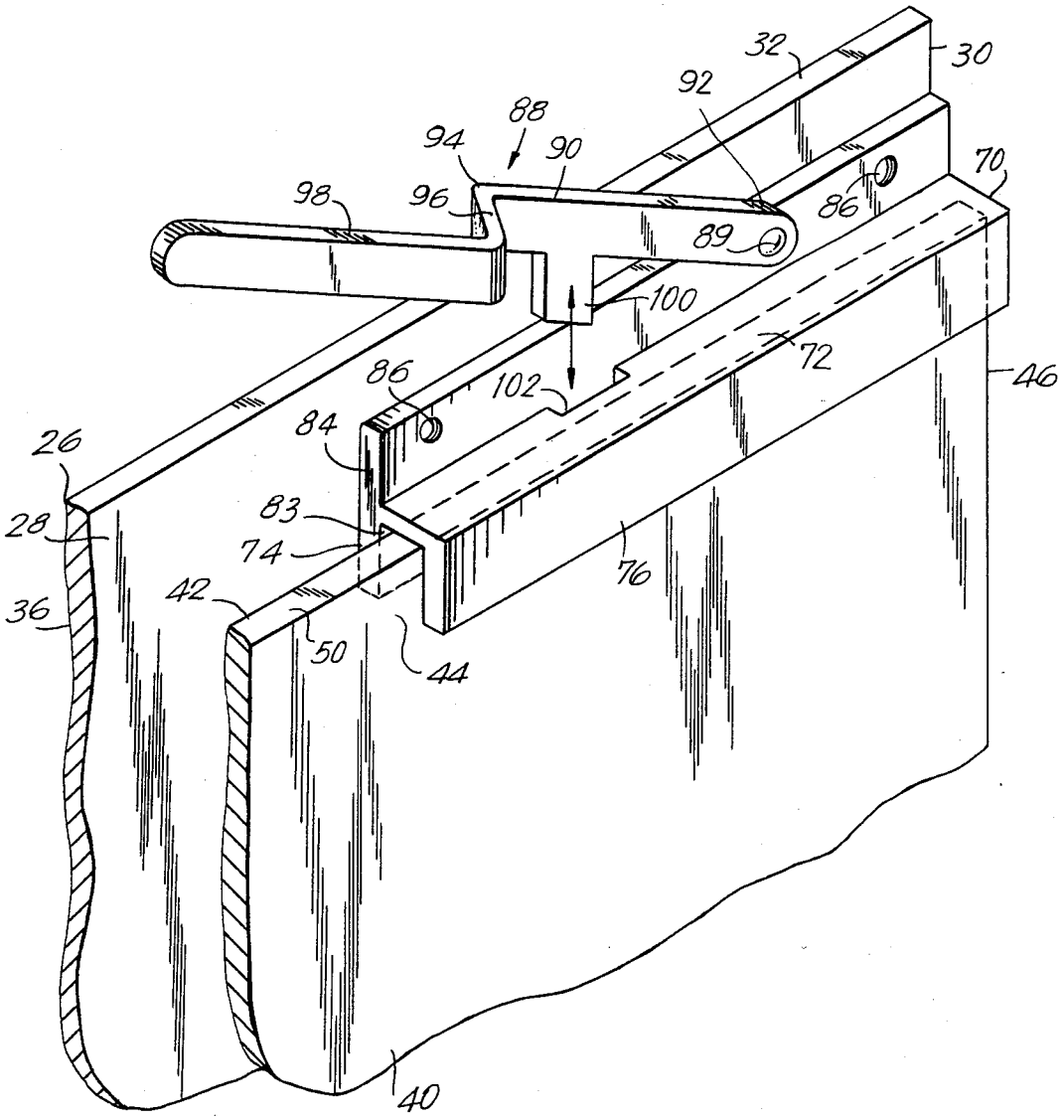
FIG. 11 is a detailed perspective view of the upper channel member and inhibiting bar.

In operation from the open position, a user raises bar member 88 from its down position shown in FIG. 3 and raises it to its up position shown in FIG. 11 by way of gripping handle portion 98. At this point, the user grips first panel 40 in a convenient manner and slides it relative to support member 26 to the extended position described. It is noted that in this movement, second panel 56 is carried along with first panel 40. Finally, the user rotates second wall 56 from the folded position away from first wall 40 to the unfolded position. The last operation achieves the closed position for aisle closer 10. The user then lowers bar member 88 so that finger member 100 is pressed into gap 83.

The reverse operation of aisle closer 10 from the closed to the open position begins with raising bar member 88 upwards so as to pull finger member 100 from gap 83. The user then presses lower plates 122 and 124 from their horizontal orientations as shown in FIG. 10 to a vertical orientation. Second panel 56 is then rotated to a folded position and first panel 40 is slid back to its unextended position relative to support member 26.

Indicia 136 imprinted on first side wall 42 of first panel 40 and outer side wall 60 of second panel 56 indicate that the particular aisle is closed when apparatus 10 is in the closed position as particularly shown in FIG. 9.

As shown in FIG. 7, an upper hinge 138 is connected to inner side wall 58 of second panel 56 and to second side wall 44 of first wall 40 for added support between the first and second panels 40 and 56.

Figure 12:
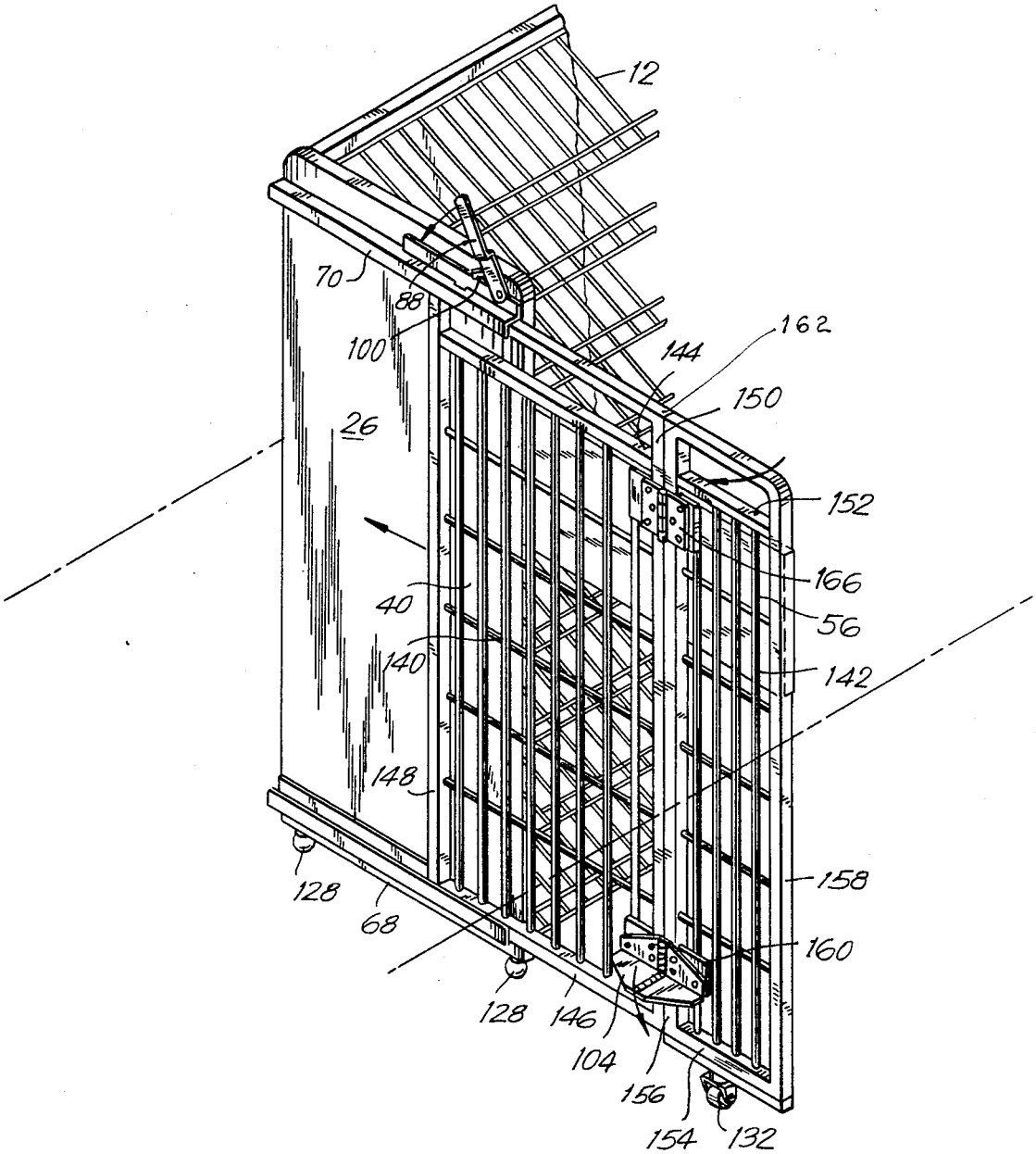
FIG. 12 is a perspective view of an embodiment of the invention having wire mesh.

An alternate embodiment of the invention is shown in perspective view in FIG. 12. First and second panels 40 and 56 are generally made of a wire mesh 140 and 142, respectively. Vertical wires of mesh 140 of first panel 40 are affixed to opposing substantially horizontal top and bottom frame members 144 and 146 respectively; and horizontal wires of mesh 140 are affixed to opposing substantially vertical inner and outer frame members 148 and 150 respectively. Similarly, vertical wires of mesh 142 of second panel 56 are affixed to opposing substantially horizontal top and bottom frame members 152 and 154, respectively; and horizontal wires of mesh 142 are affixed to opposing substantially vertical adjoining and distal frame members 156 and 158, respectively, with adjoining frame member 156 being in adjoining relationship with vertical outer frame members 150 of first panel 40 and distal frame member 158 being in distal relationship with vertical outer frame member 150. Hinge 104 is affixed to vertical outer frame member 150 and to adjoining vertical frame member 156 via a mounting piece 160.

A substantially horizontal upper riding member 162 is spaced over top frame member 144 of first panel 40; riding member 162 is adapted to slide in upper channel member 70. Finger member 100 of bar member 88 is adapted to inhibit the movement of riding member 162. A horizontal upper bar member 164 spaced below top frame member 152 preferably aesthetically matches upper riding member 162. Similarly, bottom frame member 154 is adapted to slide in lower channel member 68.

A wheel 132 is mounted to the bottom of bottom frame member 154 and foot members 128 are affixed to the bottom of support member 26, which is affixed to a vertical surface of a display rack 12. An upper hinge 166 is affixed to outer frame member 150 and adjoining frame members 156.

The embodiments of the present invention as particularly disclosed are presented merely as examples of the invention. Other embodiments, forms, and modifications of the invention coming within the proper scope of the appended claims will, of course, readily suggest themselves to those skilled in the art.

What is claimed is:

1. An aisle closer apparatus for an aisle comprising, in combination: an adjacent support means having a substantially vertical surface and a substantially vertical side edge adjoining said aisle, a substantially vertical first panel having opposed first and second side walls and substantially vertical first and second side edges, a substantially vertical second panel having opposed inner and outer side walls and substantially vertical inner and outer side edges, channel means connected to said support means for mounting said first panel relative to said substantially vertical surface wherein said first panel is in generally parallel relationship with respect to said support means, said first panel being slidably movable in said channel means between an unextended position and an extended position, wherein in said unextended position said first side wall of said first panel is facing and spaced proximate from said substantially vertical surface of said support means and said substantially vertical side edge of the support means and said substantially vertical first side edge of the first panel are in substantial alignment, and wherein in said extended position said substantially vertical first side edge is distantly positioned beyond said substantially vertical side edge of said support means, means for inhibiting said first panel from moving from any of said unextended or extended positions; and hinge means connecting said first and second panels including a foot activated hinge with orthogonal folding connected to said second side wall at said first side edge of said first panel and to said inner wall adjacent said inner edge of said second panel, said hinge upon activation by means of one's foot triggers a pair of normally right angle folded hinge plates which enables rotational movement of said second panel relative to said first panel between an unfolded position and a folded position and for releasably holding said first and second panels in said folded and said unfolded positions, and said foot activated hinge being a hinge member having a pair of vertical joints with first biasing means and having a pair of horizontal joints having second biasing means; said second biasing means maintaining said first and second panels in said unfolded position, and said first biasing means retaining said first and second panels in said folded position; wherein in said folded position said second side wall of the first panel and said inner wall of the second panel are substantially parallel and facing in spaced proximity and in said unfolded position said inner and outer side walls of said second panel are positioned lengthwise in planar relationship with said second and first side walls respectively of said first panel, said apparatus being movable between an open position and a closed position, wherein in said open position said first panel is in said unextended position and said first and second panels are in said folded position, and in said closed position said first panel is in said extended position and said first and second panels are in said unfolded position.

2. An aisle closer apparatus according to claim 1, wherein said first panel includes approximately horizontal upper and lower edges; said channel means includes a substantially horizontal upper channel member forming an elongaed downward facing upper slot, said upper channel member being affixed to the upper portion of said surface of said support member; and a substantially horizontal lower channel member forming an upward facing elongated lower slot, said lower channel member being the lower portion of said surface of said support means said upper and lower slots being adapted to slidably receive said upper and lower edges respectively of said first panel.

3. An aisle closer apparatus according to claim 2, wherein said inhibiting means is a pivotable bar member connected to said surface of said support means for inhibiting by means of a wedge said first panel from moving from either said unextended position or said extended position.

4. An aisle closer apparatus according to claim 3, wherein said upper channel member includes a substantially horizontal channel top wall and a substantially vertical first and second channel side walls secured to said channel top wall, said second side wall and said upper edge of said first panel are in sliding relationship with said channel second side wall and said channel top wall respectively and said first channel side wall is spaced proximate to said first side wall of said first panel; said upper channel member further including a connecting plate member secured to said first channel side wall and to said surface of said connecting member; said plate member and said first wall of said first panel forming a substantially vertical gap.

5. An aisle closer apparatus according to claim 4, where said means for inhibiting is a substantially horizontal bar member having an elongated bar portion positioned directly over said gap and having a connecting end spaced from said support means side edge and rotatably connected to said plate member and an opposed end distal from said support means side edge; a cross-bar connected at one end to said opposed end and extending transversely over said upper channel member; and an elongated handle portion connected to the other end of said cross-bar and extending lateral to said elongated bar portion extending away from said support means side edge; and said inhibiting means being in the form of a wedge having a finger member extending substantially perpendicularly from the under side of said bar portion; said channel top wall forms a recess opening into said gap and is adapted to receive said finger member of said wedge; said bar member being rotatable movable between an inhibiting position and a free position, wherein in said inhibiting position said finger member of said wedge is positioned through said recess into said gap in a wedging frictional relationship with said plate and with said first side wall of said first panel and in said free position said finger member is spaced from said recess; whereby said finger member can be positioned in said inhibiting position when said apparatus is in either of said open position or said closed position.

6. An aisle closer apparatus according to claim 5, wherein said second panel includes a top edge substantially horizontally aligned in a plane with said upper edge of said first panel.

7. An aisle closer apparatus according to claim 6, further including means attached to said second panel for movably supporting said first and second panels during movements between said unextended and extended positions and for movably supporting said second panel relative to said first panel during movements between said folded and unfolded positions, said means for movably supporting being a wheel attached to the bottom side of said second panel.

8. An aisle closer apparatus according to claim 7, wherein said support means comprises a display rack having a substantially vertical rack surface transverse to said aisle and a substantially vertical rack side edge adjoining said aisle.

9. An aisle closer apparatus according to claim 8, wherein said support means having opposed substantially vertical support member surfaces and a substantially vertical support member side edge substantially in alignment with a side of a display rack, one of said support member surfaces being affixed to said rack, and said channel means being affixed to the other of said support member surfaces.

10. An aisle closer apparatus according to claim 7, further including indicia on said first wall of said first panel and said inner wall of said second panel, said indicia indicating that an aisle is closed when said apparatus is in said closed position.

11. An aisle closer apparatus according to claim 1, wherein said first and second panels are formed of wire mesh.

* * * * *